United States Patent [19]

Milliron et al.

[11] Patent Number: 4,602,771

[45] Date of Patent: Jul. 29, 1986

[54] APPARATUS FOR CASTING REFRACTORY COMPOSITIONS

[75] Inventors: Joseph E. Milliron; Alvin W. Barrett; Robert H. Phillips, all of Clearfield County, Pa.

[73] Assignee: Narco Investors, Inc., Cleveland, Ohio

[21] Appl. No.: 670,522

[22] Filed: Nov. 9, 1984

[51] Int. Cl.[4] ..... F27D 1/16

[52] U.S. Cl. ..... 266/281; 425/60; 425/425

[58] Field of Search ..... 266/281, 287; 264/30; 425/60, 425

[56] References Cited

U.S. PATENT DOCUMENTS 3,716,316 2/1973 Dekker et al. ..... 266/281

3,779,679 12/1973 Bisinella et al. ..... 266/281

4,279,844 7/1981 Danjyo et al. ..... 264/30

4,421,697 12/1983 Taguchi et al. ..... 264/30

*Primary Examiner*—L. Dewayne Rutledge

*Assistant Examiner*—Robert L. McDowell

*Attorney, Agent, or Firm*—Jones, Day, Reavis & Pogue

[57] ABSTRACT

The present invention provides an apparatus useful in a cast lining process. In the cast lining process, a mandrel is positioned inside a vessel to be lined, so as to form a casting space, and a castable is delivered into the casting space to produce the cast lining. The novel apparatus of the present invention includes a rotatable and horizontally movable belt conveyor arranged above the casting space. The preferred apparatus also includes a contractable and expandable mandrel. Also provided by the present invention is an improved cast lining process.

8 Claims, 9 Drawing Figures

APPARATUS FOR CASTING REFRACTORY COMPOSITIONS

TECHNICAL FIELD

This invention relates to an apparatus for use in the cast lining process and to an improved cast lining process based upon this apparatus.

BACKGROUND ART

A cast lining process is known, in which a core or mandrel is placed at a predetermined location within a vessel such as a ladle used in the making of steel; in which an amorphous refractory is cast into the space between the core and a permanent lining refractory previously installed in the vessel, so as to apply an inner lining to the vessel; and in which the core is removed from the vessel after the lining is cured.

In one type of apparatus used in this process, an inverted cone having an inclined angle between 45° and 50° is used for feeding the amorphous refractory into the casting space. This type of apparatus is illustrated by U.S. Pat. No. 4,421,697 to Taguchi et al. A substantial disadvantage of this type of apparatus is that not all castables will slide down a 45°–50° inclined slope. A further deficiency of this type of apparatus is that the inverted cone tends to entrap gas. This drawback is significant for a castable that gives off an explosive gas as it cures.

A further drawback of this type of apparatus is that it is useful with vessels of only limited cross-sectional shape, particularly circular or elliptical.

A further problem with apparatus used in the cast lining process is difficulty in removing the core after curing of the lining is completed. This problem is particularly acute when a castable that expands during cure is used.

From the above discussion, it is clear that there is a need for an apparatus useful in this process, that makes possible the use of a castable that will not slide down a 45°–50° inclined slope. Such an improved apparatus would be especially useful if it were capable of also utilizing a free flowing material. Such an improved apparatus would be even more useful if it did not tend to entrap any gas, in particular any explosive gas, given off during cure of the castable. Moreove, such an improved apparatus would provide an even greater contribution to the art if the could be used with a vessel of any given cross-sectional shape so long as the vessel did not have any sharp bends in the shape thereof. Furthermore, such an improved apparatus would further advance the art if it provided for facile removal of the core or mandrel, even when a castable that expands during cure is used. Clearly, such an apparatus would make possible an improved cast lining process.

DISCLOSURE OF THE INVENTION

It is accordingly an object of the present invention to provide an apparatus useful in the cast lining process, that makes possible the use of a castable that will not slide down a 45°–50° inclined slope.

It is a further object of the present invention to provide an apparatus of this type that is also useful with a free flowing castable.

It is an even further object to provide an apparatus of this type that does not tend to entrap any gas, in particular any explosive gas, given off during cure of the castable.

It is a still further object to provide an apparatus of this type that is useful with a vessel of any given cross-sectional shape so long as the vessel does not have any sharp bends in the shape thereof.

It is an additional object to provide an apparatus of this type that provides for facile removal of the mandrel, even when a castable that expands during cure is used.

It is an even additional object to provide an improved cast lining process.

Additional objects, advantages and novel features of the present invention are set forth in the description that follows, and in part will become apparent to those skilled in the art upon examination of the following description or may be learned by practice of the invention. The objects and advantages of the invention may be realized and attained by means of instrumentalities and combinations particularly pointed out in the appended claims.

To achieve the foregoing objects and in accordance with the purpose of the present invention, as embodied and broadly described herein, there is provided an apparatus useful in a cast lining process in which a casting space is formed between an inner wall of a vessel and a mandrel positioned within the vessel. The apparatus includes a belt conveyor arranged above the casting space for feeding a castable into the casting space. The belt conveyor is rotatable, and rides on and supported by wheels in a wheel/track assembly and thereby is horizontally movable. The belt conveyor has guide rolls for causing a feed end of the belt conveyor to be horizontally adjusted so as follow the cross-sectional contour of the vessel and thereby be positioned to deliver the castable into the casting space.

Also provided is a mandrel formed of vertical sections, two of which are trapezoidally shaped and adapted for horizontal movement to expand and contract the mandrel.

In addition, there is provided by the present invention an improved cast lining process. This process includes rotating a device for delivering a castable into the casting space, and causing the device to be horizontally adjusted vis-a-vis the cross-sectional contour of the vessel so as to cause a feed end of the device to follow the cross-sectional contour and thereby be positioned so as to deliver the castable into the casting space as the device is rotated.

In the drawing and in the detailed description of the invention that follows, there is shown and essentially described only a preferred embodiment of this invention, simply by way of illustration of the best mode contemplated by us of carrying out this invention. As will be realized, this invention is capable of other and different embodiments, and its several details are capable of modification in various respects, all without departing from the invention. Accordingly, the drawing and the detailed description are to be regarded as illustrative in nature, and not as restrictive.

BRIEF DESCRIPTION OF THE DRAWING

Reference is now made to the accompanying drawing, which forms a part of the specification of the present invention, and which depicts a preferred embodiment of an apparatus in accordance with the present invention.

BEST MODE FOR CARRYING OUT THE INVENTION

As explained above, the present invention is directed to a novel apparatus useful in the cast lining process and to an improved cast lining process using this unique apparatus. A considerable advantage of this invention is that it makes possible the use of a castable that will not slide down a 45°–50° inclined slope. A castable of this type is very stiff and hence not free flowing. Beneficially, this invention is also useful with a free flowing castable. A further advantage is that the novel apparatus of this invention does not tend to entrap any gas, in particular any explosive gas, given off during cure of the castable. Moreover, the improved apparatus of this invention can be used with a vessel of any given cross-sectional shape so long as the vessel does not have any sharp bends in the shape thereof. Furthermore, this improved apparatus provides for facile removal of the mandrel, even when a castable that expands during cure is used. In short, this invention is useful with a wide variety of castables ranging in flow characteristics from free flowing to very stiff and not free flowing, and including those that give off an explosive gas or expand during cure, and is useful with vessels having a wide variation in cross-sectional shape.

Figure 1:
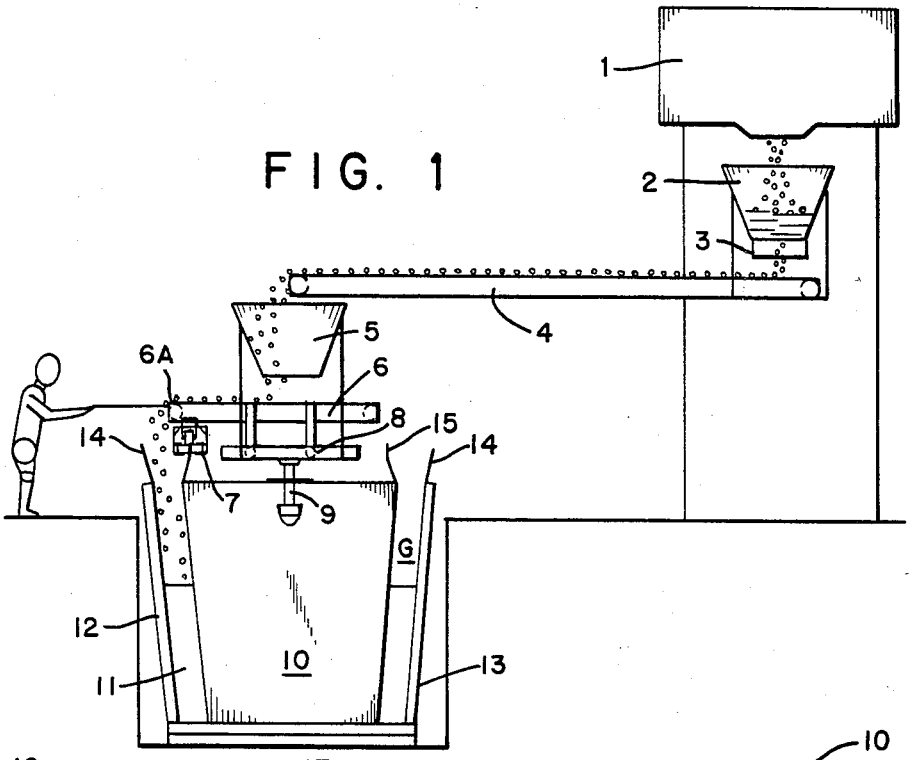
FIG. 1 is a schematic diagram showing an improved cast lining process based upon a preferred embodiment of an apparatus in accordance with the present invention.

Prior to describing the details of the present invention, an overview of an improved cast lining process based upon a preferred embodiment of an apparatus in accordance with the present invention, is now provided. Referring to FIG. 1, ingredients for forming a castable are added to a mixer 1, and after having been mixed for an appropriate period of time, the castable is dropped down into a holding hopper 2 having a gate valve 3 for controlling the feed rate of the castable onto a belt conveyor 4. Conveniently, valve 3 is manually controlled. The castable drops off the feed end of conveyor 4 through a guide chute 5 onto a rotatable conveyor 6. The guide chute functions to control spillage of the castable onto conveyor 6. Attached to a feed end 6A of conveyor 6 are guide rolls 7, for controlling the linear in-and-out movement of conveyor 6, which rides on wheels in a wheel/track assembly 8. Situated below conveyor 6 is a support shaft 9 for supporting conveyor 6. In addition, shaft 9, makes possible a 360° rotation of conveyor 6. Shaft 9 is supported by a hold-down beam assembly (shown in FIG. 9).

The castable drops off the feed end of conveyor 6 into a casting space G to form a cast lining 11. Space G is the gap between a mandrel 10 and a refractory safety lining 12, which is previously installed in a molten metal vessel 13. The castable is guided into the casting space by an apron/chute 14. Guide rolls 7 run around an inside circumferential wall 15 of the apron/chute.

Figure 5:
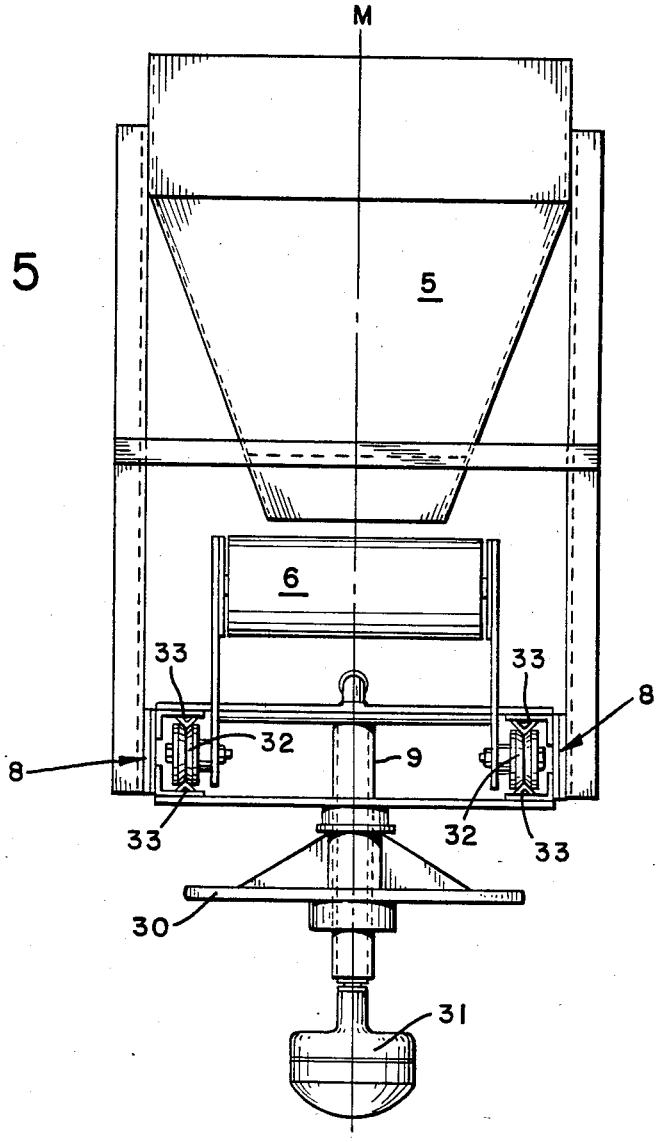
FIG. 5 is a magnified end view of a belt conveyor 6 of FIG. 1, showing details of a wheel/track assembly 8 and a support shaft 9, and illustrating the vertical axis M of conveyor 6.

Holding a rod connected to the frame of conveyor 6, an operator walks around the outside of vessel 13 and thereby rotates conveyor 6 around its vertical axis M (shown in FIG. 5). The operator rotates the conveyor at a speed dependent upon the visually observed flow of castable off the feed end of conveyor 6. As the conveyor is rotated, it moves linearly in-and-out in response to the location of guide rolls 7 on circumferential wall 15. The castable is added a small amount at a time as the operator goes around and around the ladle. The operator does this until the ladle is completely full.

Figure 2:
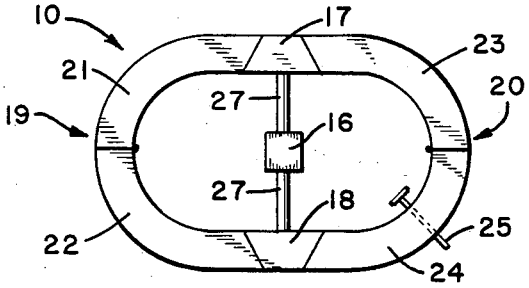
FIGS. 2–4 are schematic diagrams showing the operation of a mandrel 10 of FIG. 1 and generally depicting the elements of the mandrel.
Figure 3:
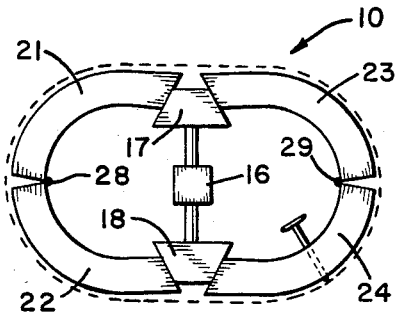
Figure 4:
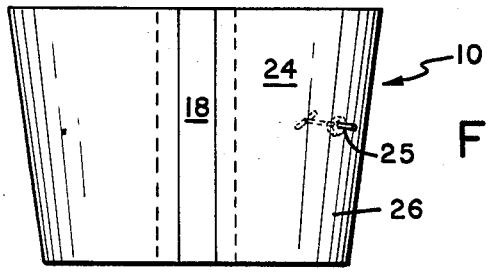

Referring now to FIGS. 2–4, a hydraulic power pack 16 is attached to and bridges between a pair of opposed trapezoidal sections 17 and 18 of the mandrel. On either side of these sections is an arcuate-shaped end section 19 and 20. End section 19 is formed by a pair of arcuate-shaped subsections 21 and 22, and subsections 23 and 24 form end section 20. Extending through the wall of subsection 24 is a locating bolt 25, for situating an outer wall 26 of the mandrel a certain distance from safety lining 12 so as to thereby define the thickness of the cast lining to be formed. Additional locating bolts are used, as will be described later.

The hydraulic power pack has arms 27 that exert pressure against trapezoidal sections 17 and 18, when the mandrel is expanded as depicted in FIG. 2. Contraction of the mandrel is initiated by retraction of arms 27, which causes the trapezoidal sections to move toward each other. As a result, the end sections are pulled inward and caused to pivot at hinges 28 and 29. FIG. 3 depicts mandrel 10 as contracted, with the dotted lines showing the cross-sectional shape of the mandrel when expanded as in FIG. 2. An can be seen in FIG. 4, a feature of the mandrel is a draft or taper to its shape.

Figure 6:
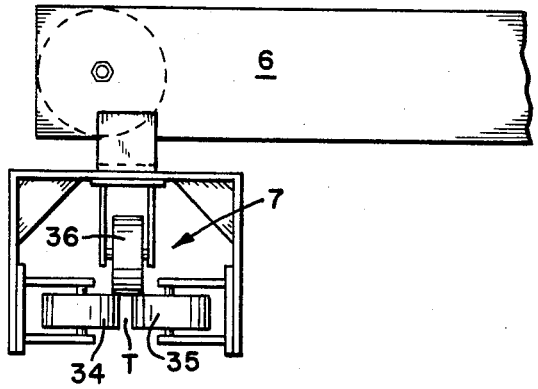
FIG. 6 is a fragmentary magnified view showing guide rolls 7 of FIG. 1.

The preferred embodiment of the apparatus of the present invention will now be described in detail. Referring to FIGS. 5 and 6, a unique feature of the present invention is rotatable conveyor 6, which is able to undergo a 360° rotation, and at the same time, to move linearly in-and-out as it tracks the cross-sectional configuration of vessel 13. To make possible the 360° rotation, conveyor 6 is mounted upon hollow shaft 9, a lower end of which connects to a support plate 30 for conveyor 6. Electrical power is fed to conveyor 6 for operation of the belt thereof, from a motor (not shown) through an electrical slip ring connector 31 and then up through hollow support shaft 9. As illustrated in FIG. 1, conveyor 6 is manually rotated by an operator as he walks around the ladle exterior. Alternatively, rotary movement of the conveyor could be accomplished automatically through the use of a motor.

To make possible and to control the linear in-and-out movement of conveyor 6, a unique wheel/track assembly 9 and guide rolls 7 are provided. The wheel/track assembly includes two pairs of v-grooved wheels 32, which run on a pair of upper and lower tracks 33 having a corresponding shape for meshing with the v-groove. Conveyor 6 rides on the v-grooved wheels, and thus wheel/track assembly 9 makes possible a linear in-and-out movement of the conveyor. An advantage of the wheel/track assembly is that it is self-cleaning; and a further feature is that pressure switches from the bottom to the top of the wheels, if conveyor 6 moves too far out on the track.

To control the linear in-and-out movement of conveyor 6 for the purpose of following the cross-sectional contour of the vessel, guide rolls 7 are used. Guide rolls 7 are advantageously attached to the feed end of conveyor 6. Guide roll assembly 7 includes two opposed wheels 34 and 35, which are horizontally positioned and spaced apart to form a gap T. A third wheel 36 is advantageous if weight-bearing capability is required. Guide rolls 7 run around inside circumferential wall 15 of apron/chute 14. The guide roll assembly makes possible use of the apparatus of the present invention for forming a cast lining on a vessel of any cross-sectional shape, so long as no sharp bends exist in the cross-sectional contour of the vessel. The shape of the vessel, for example, could be irregular, elliptical, eggshaped or round.

Figure 7:
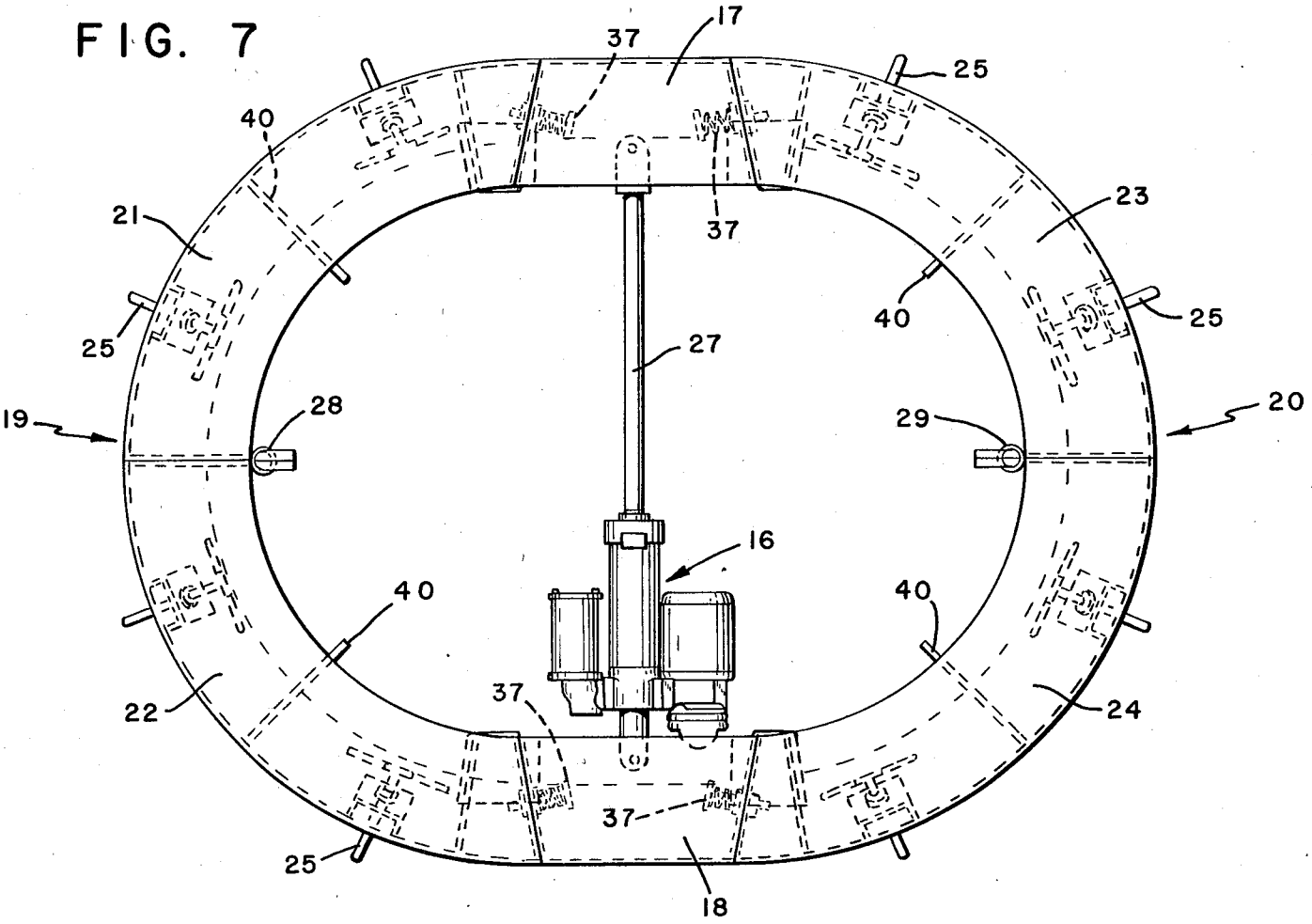
FIG. 7 is a top view of mandrel 10 of FIG. 1.
Figure 8:
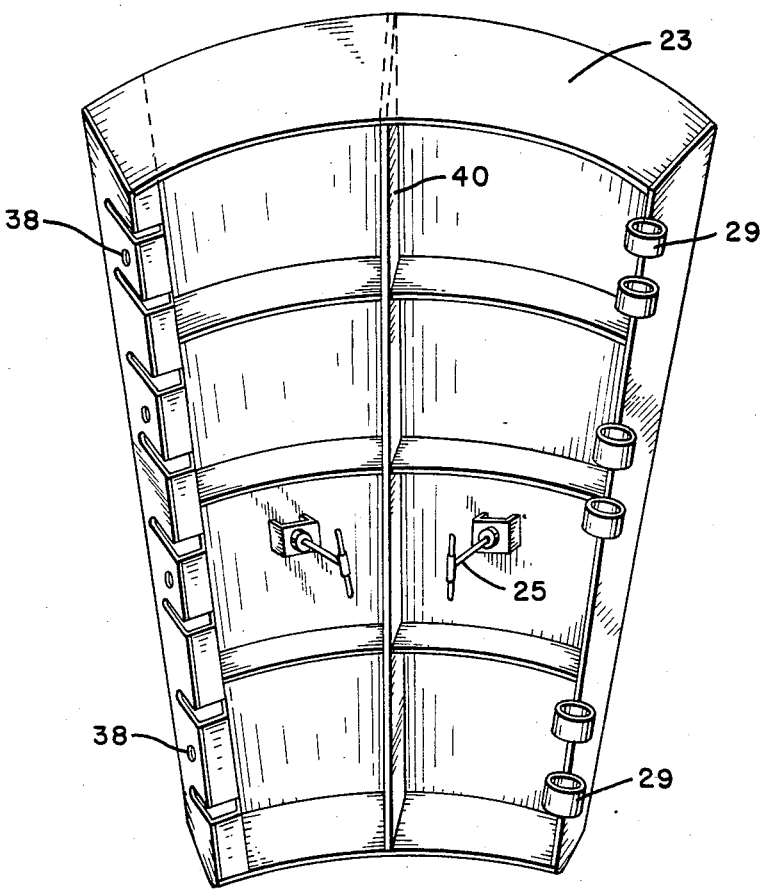
FIG. 8 is an isometric view of a subsection 23 of the mandrel of FIG. 7.

Referring to FIGS. 7 and 8, another unique aspect of the preferred apparatus of the present invention is expandable and contractable mandrel 10. Mandrel 10 includes a pair of opposed, trapezoidally-shaped sections 17 and 18, and a pair of arcuate-shaped end sections 19 and 20. End section 19 is formed by a pair of arcuate-shaped subsections 21 and 22 joined by hinge 28, and arcuate-shaped subsections 23 and 24, which are joined by hinge 29, form end section 20. The trapezoidal sections join to the end sections via compression spring-/bolt assemblies 37, shown in phantom, to provide a pressured joint. Four such assemblies are shown in FIG. 7, and work in slots 38 located in the vertical edges of the end sections. In order to provide equalized pressure, four spring/bolt assemblies are used per trapezoidal section edge/end section edge junction for a total of sixteen in the mandrel.

Centrally located within the mandrel is a pair of hydraulic power packs 16, one located directly above the other. Each power pack is attached to and bridges between the two trapezoidal sections. Each hydraulic power pack consists of a cylinder, motor and reservoir. The pair of power packs cooperate to exert uniform pressure vertically against the trapezoidal sections.

Release of pressure on the trapezoidally-shaped sections and contraction of the mandrel is initiated by retraction of arms 27 so as to cause the trapezoidal sections to move about an inch toward each other. As a result, spring/bolt assemblies 37 slide and the end sections are pulled inward. This movement in turn causes the end sections to pivot very slightly at hinges 28 and 29, and the mandrel to contract. Thus, retraction of arms 27 so as cause the trapezoidal sections to move toward each other about an inch effects contraction and separation of the mandrel from the cast lining. Once loosened from the lining, the mandrel can be removed as a unit.

Attached to the inside of the mandrel via mounting plates 40 are conventional vibrators (not shown). Mandrel 10 has four mounting plates, with two vibrators being mounted per plate. The intensity of vibration required and the choice of the particular area to be vibrated at a given time, are dependent upon the castable in use, and are within the skill of an experienced mechanic. For the castable that will not slide down a 45°–50° inclined slope mentioned earlier, a great deal of vibration is required to densify the castable. A useful vibrator is a pneumatic rotary eccentric vibrator available from Martin Engineering Company. This type of vibrator is equipped to accept a muffler for quiet operation. Vibration is used as required: typically, the general area to which the castable is added, is vibrated.

In FIG. 7, four locating bolts are shown. Advantageously, a total of eight locating bolts are used with mandrel 10.

Some castables expand as they set. The contractable mandrel of the present invention is particularly advantageous for use with this type of castable. Furthermore, contractable mandrel 10 is advantageous as over the normal course of use a mandrel becomes slightly out of shape and thus more difficult to remove.

Figure 9:
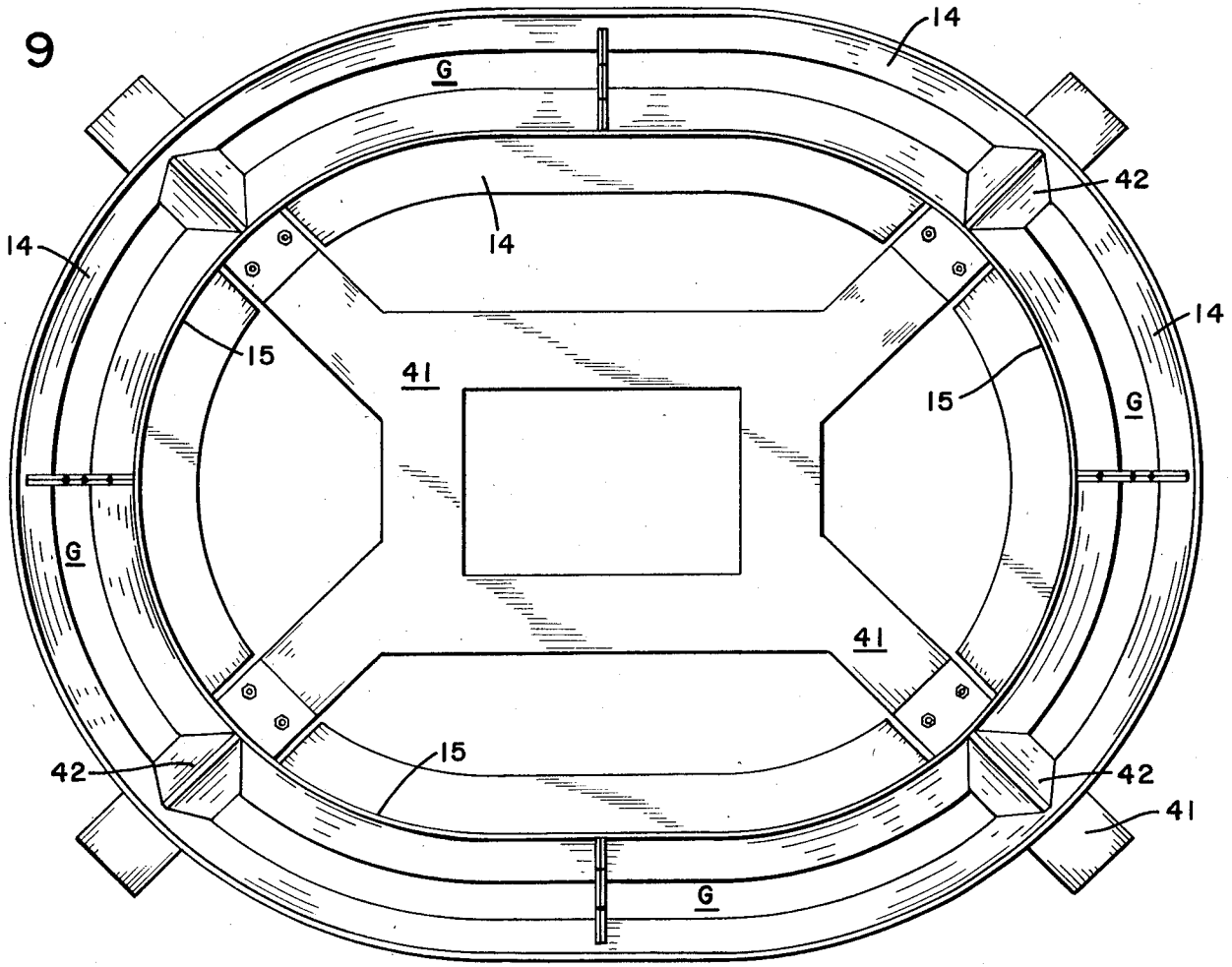
FIG. 9 is a top view showing details of a combination chute/apron 14, which is schematically represented in FIG. 1, the chute/apron being arranged above a vessel 13 and mandrel 10 of FIG. 1, neither of which is seen in FIG. 9.

Referring to FIG. 9, a top view of apron/chute 14 is shown, in which the apron/chute is arranged above vessel 13 and mandrel 10, neither of which is seen in this view. Also shown in this Figure is hold-down beam assembly 41. Each arm of the hold-down beam assembly is bolted to vessel 13. This assembly is used to exert pressure on the mandrel to keep it in place; otherwise, the mandrel might rise up when vibration begins. Near the end of each arm of the hold-down beam assembly a deflector 42 is used to cover the flat upper surface presented by each arm. In addition to deflecting the castable into casting space G, the deflectors permit air and electrical power lines to be run into the inside of the apparatus. Support plate 30 for conveyor 6 bolts to an upper surface of hold-down beam assembly 41.

The procedure of lining a vessel using the preferred embodiment of the apparatus of the present invention will now be described. Vessel 13 is first placed into a pit, and mandrel 10 is lowered into the vessel. Using locating bolts 25, outer wall 26 of the mandrel is situated a certain distance from the brick safety lining to form casting space G, which when filled with the castable, produces a cast lining of the desired thickness. The hydraulic power pack is used to expand the mandrel.

After the mandrel is set in place, hold-down beam assembly 41 is placed over the mandrel to exert pressure thereon to keep the mandrel in place. The arms of assembly 41 are attached to vessel 13. Conveyor 6 is bolted onto the upper surface of assembly 41 via support plate 30.

A two ton batch of ingredients for forming the castable is placed in mixer 1, and after having been mixed for approximately 3 or 4 minutes, the castable is dropped down into holding hopper 2, which can hold about 1½ batches of the castable. On the bottom of the hopper 2 is a large clam shell gate 3. Flow of material through the gate onto conveyor 4 is manually controlled. Belt conveyor 4 is a straight twenty foot belt conveyor having an aluminum frame. The material drops off the feed end of the belt conveyor straight down onto rotatable conveyor 6 via guide chute 5. Alternatively, hopper 2 could be located above guide chute 5 so that the castable would be delivered directly from hopper 2 via chute 5 onto conveyor 6. Conveyor 6 is rotated at a speed dependent upon the visually observed flow of material off the feed end thereof, and moves linearly in-and-out as it follows the cross-sectional configuration of vessel 13. The castable drops almost straight down into vessel 13 through apron/chute 14. As the castable falls into casting space G, mandrel 10 is vibrated using one or more of the air vibrators. The castable is added a small amount at a time as the operator walks around the vessel until the casting space is completely full.

If the castable does give off an explosive gas during cure, this apparatus has the advantage of not entrapping the gas and furthermore is easy to ventilate by use of fans, blowers and so forth.

In the preceding description of the present invention, there is shown and essentially described only a preferred embodiment of this invention, but as mentioned above, it is to be understood that the invention is capable of changes or modifications within the scope of the inventive concept expressed herein. Several changes or modifications have been briefly mentioned for purposes of illustration.

INDUSTRIAL APPLICABILITY

This invention is useful in the cast lining process.

We claim:

1. An apparatus useful in a cast lining process in which a casting space is formed between an inner wall of a vessel and a mandrel positioned within said vessel, said apparatus comprising a belt conveyor arranged above said casting space to drop off a castable into said casting space, said belt conveyor being rotatable and riding on and supported by wheels in a wheel/track assembly and thereby being horizontally movable, and said belt conveyor having guide means for causing a feed end of said belt conveyor to be horizontally adjusted so as follow the cross-sectional contour of said vessel and thereby be positioned so as to drop off said castable into said casting space.

2. The apparatus of claim 1, wherein said mandrel is formed of vertical sections, two of which are trapezoidally shaped and adapted for horizontal movement to expand and contract said mandrel.

3. The apparatus of claim 2, wherein means for pushing said two trapezoidal sections away from each other or for pulling said two trapezoidal sections toward each other, is attached to each of, and bridges, said two trapezoidal sections, whereby said mandrel is caused to expand or contract.

4. The apparatus of claim 1, comprising vibrating means for vibrating said mandrel.

5. The apparatus of claim 1, wherein said guide means comprises a pair of wheels oriented horizontally and and spaced apart from each another to form a gap.

6. The apparatus of claim 5, wherein said guide means comprises a third wheel oriented vertically and arranged above said gap.

7. The apparatus of claim 6, wherein said guide means rolls around an inside circumferential wall of means for guiding said castable into said casting space.

8. The apparatus of claim 1, comprising means for ventilating gas from said casting space.

* * * * *